United States Patent [19]

Fritsch

[11] 4,115,278

[45] Sep. 19, 1978

[54] CONICAL FILTER BASKET FOR A CONTINUOUSLY OPERATING CENTRIFUGE

[76] Inventor: Willi Fritsch, Grunweg 26, Rommerskirchen, Fed. Rep. of Germany, 4049

[21] Appl. No.: 782,712

[22] Filed: Mar. 30, 1977

[30] Foreign Application Priority Data

Apr. 7, 1976 [DE] Fed. Rep. of Germany ..... 2614922

[51] Int. Cl.[2] ..... B01B 25/16

[52] U.S. Cl. ..... 210/488; 210/497 R; 210/497.1; 233/1 E

[58] Field of Search ..... 210/480 R, 488, 497, 210/497.1; 233/1 E, 2

[56] References Cited

U.S. PATENT DOCUMENTS

| | | | |
|---|---|---|---|
| 2,084,433 | 6/1937 | Chorlton | 210/497.1 X |
| 2,489,292 | 11/1949 | Hobbs | 210/497 |
| 2,801,824 | 8/1957 | Taprogge | 210/152 X |
| 3,425,561 | 2/1969 | Steele et al. | 210/497.1 X |
| 3,630,379 | 12/1971 | Sharples | 210/497.1 X |

*Primary Examiner*—Morris O. Wolk
*Assistant Examiner*—Michael S. Marcus
*Attorney, Agent, or Firm*—Toren, McGeady and Stanger

[57] ABSTRACT

A conical filter basket for a continuously operating centrifuge for the separation of solids from a solids-liquid mixture comprises a base, a number of supports attached to the base and extending upwards and outwards from the base, an upper end ring attached to the upper ends of the supports, and bars of uniform cross-section attached to the inner side of the supports so that they are mutually spaced from one another between the base and the upper end ring to provide gaps for the escape of liquid from the basket. The bars are usually a series of co-axial rings and are arranged so that the internal surface of the filter basket is stepped whereby the annular filter gap formed between each pair of rings is located at the bottom of an annular pocket which diverges from the gap upwardly and inwardly with respect to the axis of the basket.

9 Claims, 4 Drawing Figures

Fig. 1
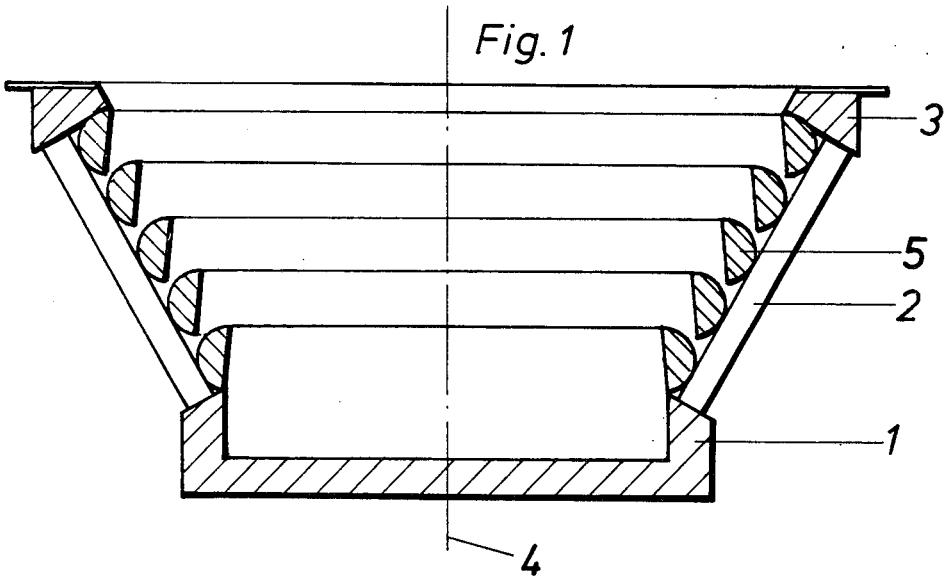
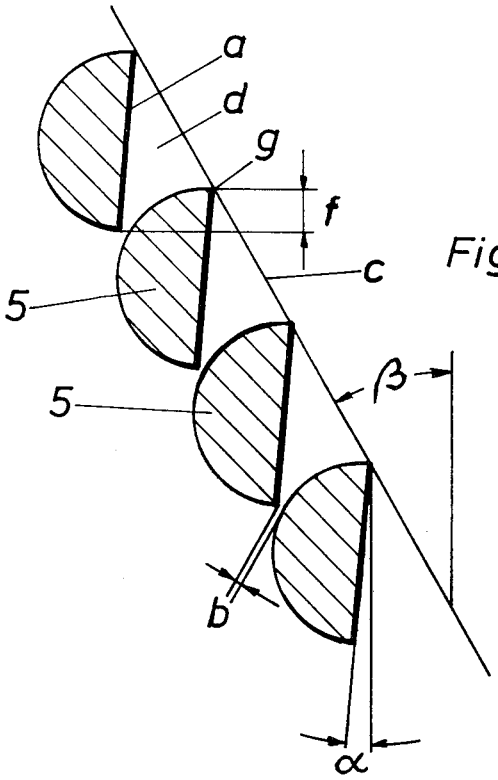
Fig. 2

Fig. 3
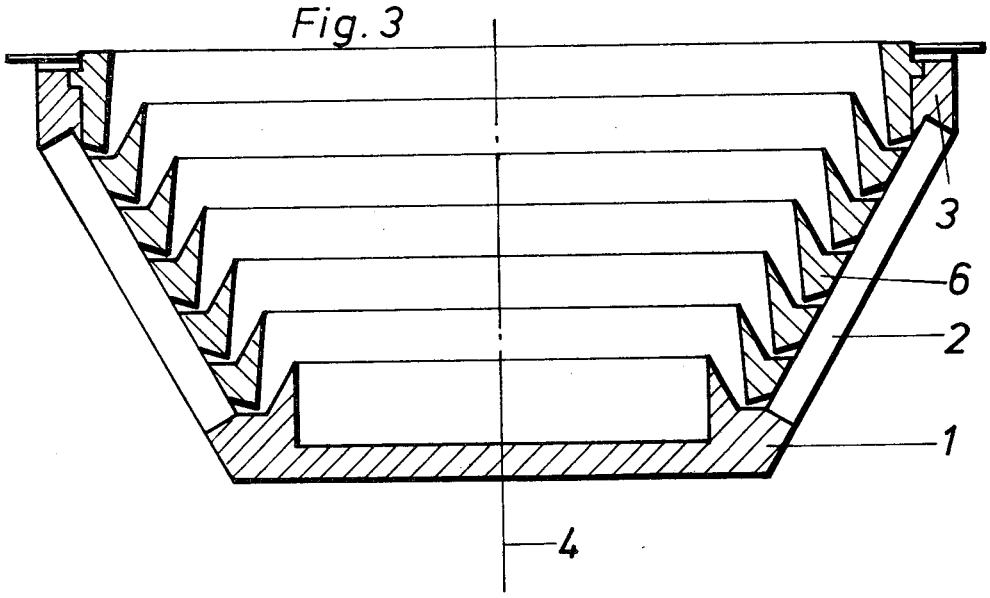
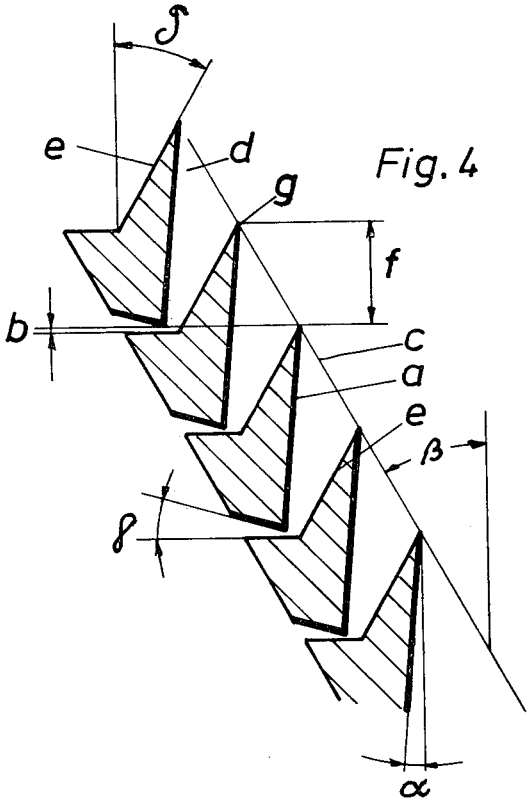
Fig. 4

CONICAL FILTER BASKET FOR A CONTINUOUSLY OPERATING CENTRIFUGE

This invention relates to a conical filter basket for a continuously operating centrifuge for the separation of solids from a solids-liquid mixture, of the kind comprising a base, a number of supports fixed to the base and extending upwardly and outwardly from the base, and an upper end ring carried by the supports.

In all known devices which are utilised for the separation of solids from solids-liquid mixtures, a sieve or filter cloth is used for retaining the solids, while the liquid passes through the surface of the sieve or filter cloth. Known plane filters, drum filters or similar separating devices are covered on the filtering surface with a filter cloth, on which a filter cake forms during operation. To accelerate the filtering process, provision may be made for ensuring a pressure difference between the chamber which contains the unfiltered material and the chamber receiving the filtrate. The filter cake is removed at regular intervals in various ways, usually by using mechanical scrapers. Filters of this type suffer from the disadvantage that they are relatively complicated in relation to their performance, especially when operation is carried out with a pressure difference between the inner and outer chambers, since this difference must be kept relatively small, on account of the large areas, in order to keep the resultant forces within acceptable limits.

For the continuous separation of solids from solids-liquid mixtures, conical sieve drums are known comprising a filter basket of the kind described and a separating surface formed by a sieve, along which the solids slide in a thin layer during the separating operation. In this type of filter, all solid particles pass over openings of the sieve several times during the separating operation, which results in the disadvantage that all solid particles of a size smaller than the sieve openings have a greater probability of passing through these openings and into the liquid chamber. In sieve drums of this type, therefore, it is only possible to attain an improved separating efficiency by making the sieve openings smaller, which, however, at the same time leads to a reduction in performance.

A further disadvantage of the known sieve drums lies in the relatively high wear of the sieve as a result of abrasion, which, especially in the case of thin sieves with openings made by electro-deposition, leads to a very short working life. In this respect, it is not only corrosion and erosion phenomena which are determining influences, but also the centrifugal forces acting on the sieve.

As sieve inlays for filter baskets, conical bar screens are also known wherein the surfaces towards the unfiltered material constitute the internally flat cone wall. Although bar screens are more resistant than the aforementioned electro-deposited sieves, they suffer from the serious disadvantage that the unavoidable wear leads to a continual increase in the size of the openings.

All hitherto known conical sieve drums, provided that as a result of their angle of slope they are self-discharging and therefore operate continuously, operate in accordance with the thin-layer principle. An additional filter layer, desirable in many cases because of its advantageous effects, can only be obtained in sieve drums of this type by the incorporation of additional components, such as dust bells, retaining discs and the like.

This, however, gives rise to the disadvantage of reduced reliability in operation, since these additional complicated components can lead to faults, quite apart from the additional expense involved.

The aim of the present invention is to create a filter basket for a continuous centrifuge of the kind described which does not possess the above disadvantages, and which renders possible in a simple manner a filtering action which avoids the thin-layer principle.

According to the invention, a conical filter basket for a continuously operating centrifuge for the separation of solids from a solids-liquid mixture comprises a base, a number of supports attached to the base and extending upwards and outwards from the base, an upper end ring carried by the supports, and bars of uniform cross-section attached to the inner side of the supports so that they are mutually spaced one from another between the base and the upper end ring to provide gaps for the escape of liquid from the basket. By the arrangement of the uniformly cross-sectioned bars, the possibility is opened up, in a surprisingly simple manner, of shaping the internal surface of the basket so that it is not flat, but is suited in a particularly optimum manner to the special requirements in that the gaps constituting the sieve openings and formed by the spacing of the bars are at the back of spaces, or pockets, formed as a result of the particular profiled shape of the bars. This makes possible, without the need for additional components, an accumulation of solids (or, if required, of filter aids introduced before the commencement of the true filtering operation) in the spaces or pockets so that a layer builds up which serves to prevent the passage of smaller particles through the sieve gaps.

The bars may be disposed spirally within the basket, in which case a single continuous spirally wound bar of uniform cross-section may be used, thereby forming one continuous spiral sieve gap. Usually, however, for the majority of applications, especially having regard to economic mass production, the bars consist of co-axially arranged rings of uniform cross-section. These can then be prefabricated to the appropriate diameters to suit the desired spacing between them and taking into account the angle of slope of the conical filter basket, and can then be fixed in a simple manner on the supports of the basket one after another, commencing with the ring of smallest diameter.

A filter basket in accordance with the invention is suitable for use with the most varied types of materials. Thus, for example, crystalline products can be separated and, if desired, cleaned, granulates produced by the plastics industry can be processed, oil-contaminated sand can be cleaned, and in the glass industry quenched glass particles can be separated from coolant, and so on.

As a result of the fact that the bars provide the basket with an internal surface which is step-shaped, even though they may all touch a common hypothetical conical boundary surface within the basket, the already mentioned pocket-like spaces disposed in front of the gaps are created, which as already explained make possible in an advantageous and simple manner the forming of a filter layer to prevent the passage of smaller particles through the gaps. Depending upon the type of material to be filtered and the degree of drying during migration inside the basket of the particles during operation, it is possible for the spacings between the bars to increase towards the top of the basket. That is to say, with decreasing liquid content, the thickness of the filter layer increases and finally fills the pocket-like spaces completely, thus causing the individual solid particles to precipitate one upon another in a bridge-like formation and to shield a comparatively large gap against the passage of smaller particles. By the use of such increasing gap sizes, improved drying of the deliquefied solids is possible.

It is particularly advantageous if the uniformly cross-sectioned bars are disposed so that they partly overlap one another when viewed in the direction of action of the centrifugal force, whereby the pocket-like spaces between the bars are formed with regions which are not subjected to the centrifugal force acting on a layer sliding over them or resting on them, and thus are not additionally compressed and the desired permeability to liquid is maintained.

In order to attain optimum functioning of the pockets in the forming of the aforementioned filter layer in front of the circumferential filter gaps, the cross-section of each bar has a flat surface which faces towards the interior of the basket and bounds a pocket, the flat surface sloping inwards towards the upper end of the basket at an angle to the axis which is preferably not more than 15°.

A particularly good separating result and flow behaviour of the material inside the basket is achieved during operation, if the angle between the axis and the conical, internal boundary surface — that is to say the imaginery surface in which the inner edge of each bar nearest to the axis lies — is approximately equal to the angle of repose of the material. The possibility also exists of arranging that this angle varies over the height of the basket in accordance with the variation in the angle of repose as a function of the varying moisture content of the material during the separating operation inside the basket. This possible construction is based upon the fact that with decreasing liquid content the angle of repose of solids increases.

The cross-section of the bars can be of various shapes, so long as it is possible to arrange the bars one above another at intervals in such a manner that a step-like or stepped back formation results on the inside of the basket, wherein each pair of adjacent bars form a circumferential gap between them with an annular pocket in front of the gap, i.e. towards the interior of the basket. One simple cross-sectional shape suitable for the bars used in the present invention is a semi-circular shape, the flat surface of the section facing towards the interior of the basket. Another suitable cross-section which may be used is bounded exclusively by straight lines. Such a cross-section, composed for example of trapeziums or triangles, offers an especially good possibility for adapting the particular angles of slope to the various types of materials to be filtered. The already mentioned surface of each bar which faces towards the interior of the basket then preferably constitutes the outer boundary of the pocket. It has proved to be particularly favourable if the outwardly facing surface is at an angle of from 15° to 30° to the axis of the basket. Within these limits, the angle should favourably be chosen to be equal to the angle of repose of the material to be filtered when liquid-free.

In order to prevent clogging in the filter gaps, sections for the bars are preferably selected which, when the bars are fixed in position, provide not only the filter gaps and the annular pockets inwards of the gaps, but also surfaces outwards of each gap which diverge from the gap. The angle of divergence is preferably at least 15°.

Two preferred examples of a filter basket in accordance with the present invention will now be described with reference to the attached drawings, in which:

FIG. 1 is an axial section taken through one of the examples;

FIG. 2 is an enlarged view of part of FIG. 1 to clarify the mutual arrangement and angular relationships of the uniformly sectioned bars of the basket, the supports upon which the bars are fixed in the installed state not being shown;

FIG. 3 is a section corresponding to FIG. 1 but taken through the second example; and, FIG. 4 is a view corresponding to that of FIG. 2 but of the filter basket illustrated in FIG. 3.

As shown in FIGS. 1 and 3, the filter basket in accordance with the invention comprises a base 1, at the periphery of which a number of supporting rods 2 are disposed, preferably symmetrically, with an outward inclination which corresponds to the desired conical angle of the basket. The supporting rods 2 are connected at their top ends to a circumferential end ring 3.

Inside the basket, the supporting rods 2 are equipped with uniformly cross-sectioned rings which are disposed at intervals one from another and co-axially about the axis 4 of the basket. Of the many, varied cross-sectional shapes which can be used for the rings, only two examples are shown in the drawings. The rings 5 of the basket shown in FIG. 1 have a semi-circular cross-section, whereas the rings 6 of the basket shown in FIG. 3 have a cross-section bounded by straight lines in the manner of a trough open at one side. Common to both examples is a flat surface *a* on each ring facing towards the interior of the basket which, as can be seen particularly from FIGS. 2 and 4, slopes downwards and outwards at an angle $\alpha$ to the axis of rotation 4. There is a circumferential annular gap *b* between each pair of adjacent rings which produces the actual separation of the solids from the liquid, the gap *b* being the minimum distance, in each case, between the rings as can be seen particularly clearly from FIGS. 2 and 4.

Although the rings 5 or 6 give a stepped or staircase-shaped form to the interior of the basket, those internal edges *g* of the rings which are nearest to the rotational axis 4 nevertheless lie in a common conical plane *c*, which extends inclined to the basket axis at an angle $\beta$. This angle should be approximately equal to the angle of repose of the material to be filtered when liquid free, but can be varied over the height of the basket for particular purposes.

In order to prevent the uninterrupted circumferential annular gaps *b* between the rings from becoming clogged, in the examples illustrated, the cross-sections of the rings are such that there are divergent surfaces outwards from the gaps. One of these divergent surfaces commences from the lower edge of the annular surface *a* of one of the rings forming a gap, and its opposite divergent surface is formed by a rearward surface of the ring below. As can be seen from the drawings, with rings having the rectilinear bounded cross-sectional shape shown in FIG. 4 the divergence from the annular gap *b* is bounded by flat surfaces, the angle between which should be at least 15°, and with rings having semi-circular rear surfaces as shown in FIG. 2, these surfaces also diverge outwardly from the annular gap *b*.

The cross-sectional shape of the rings shown in FIG. 4 provides the possibility of determining by angle the pockets *d* disposed in front of the gaps *b*, since the surface *a* of each ring which faces towards the interior of the basket, together with the opposite outwardly facing surface *e* of the adjacent lower ring forms a pocket *d*. It has proved advantageous if the angle of inclination of the surfaces *e* is from 15° to 30° relative to the rotational axis 4; preferably being equal to the angle of repose of the liquid-free product to be processed in each case. Care should be taken to ensure that the angle $\delta$ is not larger than the angle of repose, since too great a compaction in the corresponding pocket must be avoided.

The step-like formation of the inside surface of the basket has the effect that the filtering operation, after a short time, leads to an accumulation of solids in the annular pockets *d*, which thus improves the filtering efficiency. The inward boundary line of the filter layer so formed corresponds approximately to the conical plane *c* on which the inner edges of the rings lie. It is, however, also possible to build up a filtering layer of other granular, crystalline, or granulate-shaped solids depending upon the material supplied to the interior of the basket, without requiring the installation of additional complicated components on the basket. By arranging the rings so that they overlap one another in the axial direction, each pocket *d* has a region of axial depth *f* behind the inner ring which is not subjected to centrifugal force. In this region, therefore, the solids are not additionally compressed by centrifugal forces of the overlying layer, so that the desired permeability for the escape of liquid is always guaranteed.

During the separation process using the filter baskets described, the deliquefied solid particles move generally in the plane *c* upwards and outwards, that is in the direction of increasing diameter, the particles executing a tilting movement in the region of the inner edges *g* of the rings in the plane *c*, which has the advantage that the surface of each solid particle which up to this time has been facing towards the rotational axis 4 is now oriented outwards and the residual liquid adhering to it is stripped off by the centrifugal force acting directly on it. This constitutes a considerable advantage by comparison with all hitherto known conical sieve drums, since with the known constructions the solids slide over the sieve and basically retain the same orientation throughout the entire separating operation. This is accompanied by the disadvantage that the residual liquid, which is situated upon the inwardly facing surface of each solid particle, is not immediately removed from the particle by centrifugal forces acting on it, but is additionally pressed onto this surface according to the angular position.

Since in almost all cases of use the maximum possible purity and low residual moisture of the deliquefied crystals or solids is required, it is necessary, with the hitherto known conical sieve drums, to add washing liquid in increased quantities, which leads to the disadvantage that some crystals can become dissolved and thereby reduce the yield. This additional operation and resultant disadvantage can be avoided with the basket in accordance with the present invention, or at least brought to an optimum in regard to its efficiency.

The manufacture of filter baskets in accordance with the present invention is extremely simple. First of all, the base 1 and the upper end ring 3 are turned, and the supporting rods 2 are made, for example of round bar material. These elements are then welded together to form a basket frame, preferably in a supporting jig. The individual uniformly cross-sectioned rings may be prefabricated, their circumference being determined according to the desired mutual spacing to form the annular gaps *b* having regard to the cone angle $\beta$ of the basket. With a supply of rings of suitably chosen diameters, the fitting of the rings in the basket frame is then extremely simple. The rings are introduced one after another into the interior of the basket frame from the bottom upwards, each being attached in a suitable manner, for example by tack welding, to the supporting rods. Finally, the drum base and upper end ring are given a finishing turning treatment and the filter basket is statically and dynamically balanced.

I claim:

1. A filter basket having a frusto-conically shaped lateral sieve surface for a continuously operating centrifuge for the separation of solids from a solids-liquid mixture, said basket having an axis of rotation and including a base extending transversely of the axis of rotation, an end ring extending transversely of the axis of rotation and spaced from said base, the sieve extending around the axis of rotation between said base and said end ring and said sieve surface comprising at least one bar-like member of uniform cross section forming a plurality of ring-like turns arranged about the axis of rotation, wherein the improvement comprises that said ring-like turns are equally spaced apart and arranged in a step-like formation with each said turn closer to said end ring than an adjacent said turn and being spaced radially outwardly from the adjacent said turn, said bar-like member having a first surface extending in the direction between said base and said end ring and having a circumferential edge closer to said end ring extending inwardly toward the axis of rotation and a second surface facing in the opposite direction from said first surface, said ring-like turns being disposed in overlapping relation in the direction of the axis of rotation of said basket and in a pair of adjacent ring-like turns said first surface of said turn closer to said end ring and the second surface of said turn closer to said base forming a pocket having an inlet opening to the interior of said basket and an outlet opening toward the exterior of said basket and said first and second surfaces forming said basket being disposed in converging relation from the inlet toward the outlet of said pocket.

2. A filter basket, as set forth in claim 1, wherein said bar-like member has a semi-circular cross-section comprising a straight side forming said first surface and a curved side forming said second surface.

3. A filter basket, as set forth in claim 1, wherein said at least one bar-like member comprises a plurality of annular bar-like members with said bar-like members having an increasing diameter in the direction from said base toward said end ring.

4. A filter basket, as set forth in claim 1, wherein said at least one bar-like member comprises a single spirally shaped bar-like member with the diameter of said spiral increasing in the direction from said base toward said end ring.

5. A filter basket, as set forth in claim 1, wherein said first surface is disposed at an angle to the axis of rotation of less than 15°.

6. A filter basket, as set forth in claim 5, wherein each of said circumferential edges of said ring-like turns being disposed in a frusto-conical plane which is disposed at an angle to the axis of rotation.

7. A filter basket, as set forth in claim 1, wherein said bar-like member has a cross-section bounded by a plurality of straight sides with said first and second surfaces being formed by said straight sides, and said second surface having a circumferential edge closer to said base inclined inwardly relative to the axis of rotation in the direction toward said end ring and forming an angle with the axis of rotation in the range of 15° to 30°.

8. A filter basket, as set forth in claim 7, wherein said bar-like member includes a third surface extending laterally outwardly from the edge of said second surface more remote from said end ring with said third surface extending transversely of the axis of rotation, a fourth surface extending from the radially outer edge of said third surface toward said base and being inclined inwardly from said third surface toward said axis of rotation, and a fifth surface extending generally radially inwardly from the edge of said fourth surface closer to said base and terminating at the edge of said first surface closer to said base.

9. A filter basket, as set forth in claim 8, wherein in a pair of adjacent said ring-like turns said fifth surface of said turn closer to said end ring is located opposite said third surface of said turn closer to said base with said fifth and third surfaces being disposed in diverging relationship in the direction radially outwardly from said axis of rotation.

* * * * *